US008274356B2

(12) United States Patent
Qin et al.

(10) Patent No.: US 8,274,356 B2
(45) Date of Patent: Sep. 25, 2012

(54) VOLTAGE DEPENDENT RESISTOR WITH OVERHEATED PROTECTION STRUCTURE

(75) Inventors: Jifeng Qin, Zhuhai Guangdong (CN); Dongjian Song, Zhuhai Guangdong (CN); Shaoyu Sun, Zhuhai Guangdong (CN)

(73) Assignee: EPCOS (Zhuhai FTZ) Co., Ltd., Guangdong (CN)

( * ) Notice: Subject to any disclaimer, the term of this patent is extended or adjusted under 35 U.S.C. 154(b) by 14 days.

(21) Appl. No.: 12/812,698

(22) PCT Filed: Jan. 14, 2009

(86) PCT No.: PCT/CN2009/070145

§ 371 (c)(1), (2), (4) Date: Nov. 17, 2010

(87) PCT Pub. No.: WO2009/089799

PCT Pub. Date: Jul. 23, 2009

(65) Prior Publication Data

US 2011/0057763 A1 Mar. 10, 2011

(30) Foreign Application Priority Data

Jan. 14, 2008 (CN) ..... 2008 2 0042850 U

(51) Int. Cl.
*H01C 7/10* (2006.01)

(52) U.S. Cl. ..... 338/20; 338/21; 361/117; 361/127

(58) Field of Classification Search ..... 338/20, 338/21; 361/117, 124, 127
See application file for complete search history.

(56) References Cited

U.S. PATENT DOCUMENTS

| | | | | |
|---|---|---|---|---|
| 4,233,641 | A * | 11/1980 | Baumbach | 361/119 |
| 5,130,884 | A * | 7/1992 | Allina | 361/117 |
| 5,608,596 | A * | 3/1997 | Smith et al. | 361/118 |
| 6,507,268 | B2 * | 1/2003 | McLoughlin | 338/21 |
| 6,943,659 | B2 * | 9/2005 | Kitsui et al. | 338/20 |
| 2007/0103268 | A1 | 5/2007 | Luo | |
| 2008/0095991 | A1 | 4/2008 | Koppel et al. | |

FOREIGN PATENT DOCUMENTS

| | | |
|---|---|---|
| CN | 02222055.0 | 4/2002 |
| CN | 200610168133 | 12/2006 |
| CN | 200620155019 | 12/2006 |
| CN | 201146087 | 11/2008 |
| JP | 2001-135502 | 5/2001 |

OTHER PUBLICATIONS

International Search Report dated Apr. 16, 2009 with translation for corresponding PCT Application PCT/CN2009/070145.
Machine Translation of Japanese Patent Publication No. 2001-135502, published May 2001.

* cited by examiner

*Primary Examiner* — Kyung Lee
(74) *Attorney, Agent, or Firm* — Fish & Richardson P.C.

(57) ABSTRACT

A resistor includes a ceramic body, metal electrodes on sides of the ceramic body, each of which is connected to an electrode lead, and an insulating layer contacting a metal electrode among the metal electrodes. The insulating layer is meltable in response to heat. A conductive connector contacts the insulating layer above the metal electrode and is configured to short the metal electrodes when the insulating layer melts.

13 Claims, 2 Drawing Sheets

VOLTAGE DEPENDENT RESISTOR WITH OVERHEATED PROTECTION STRUCTURE

TECHNICAL FIELD

This patent application describes voltage-dependent resistor with overheat protection structure that is unlikely to explode and burn.

BACKGROUND

Zinc oxide voltage-dependent resistors are a new technology which has been developed since the 1970s. The voltage-dependent resistor has a certain switching voltage (called voltage-dependent voltage). Below this voltage, the voltage-dependent resistor will have a very high resistance, which is equivalent to the insulation state. When given a high voltage impulse (higher than the voltage-dependent voltage), the voltage-dependent resistor will have a very low resistance, which is equivalent to the short circuit state. When the voltage which is higher than the voltage-dependent voltage disappears, it returns to its high resistance state.

If the zinc oxide voltage-dependent resistor is installed in electrical equipment, when an excessively high voltage, which is higher than its rated work voltage, is applied to the voltage-dependent resistor, the voltage-dependent resistor may be broken down by the excessively high voltage, resulting in an over-high current flowing through the voltage-dependent resistor, thus causing the voltage-dependent resistor to explode and burn, which becomes a safety concern for the surrounding electrical equipment.

Chinese patent No. 02222055.0 discloses a voltage-dependent resistor with thermal protection, which includes a housing and a voltage-dependent resistor enclosed by the housing. The voltage-dependent resistor is composed of a voltage-dependent ceramic substrate and an insulated enveloping layer which encloses the voltage-dependent ceramic substrate. The voltage-dependent resistor has a first lead-out electrode and a second lead-out electrode, wherein one end of the first lead-out electrode and one end of the second lead-out electrode are respectively connected to the two electrode leads of the voltage-dependent ceramic substrate, and the other end of the first lead-out electrode and the other end of the second lead-out electrode extends beyond the housing, and further has a metal spring and a third electrode, wherein the metal spring is arranged in the housing, the voltage-dependent resistor has a metal heat conductor connecting to an inner electrode of the voltage-dependent ceramic substrate, one end of the metal spring is welded to the metal heat conductor via a low melting-point metal, and the other end of the metal spring is secured onto the housing and connected to the third electrode, and the third electrode has a leading end extending beyond the housing.

Chinese patent No. 200620155019.4 discloses a voltage-dependent resistor with overheat protection structure which is mainly composed of a housing, pins arranged in the housing, and spring tabs connecting to the pins. One of the pins at the end of the voltage-dependent resistor which is serially connected to the overheat protection structure is welded to the free end of the spring tab via a metal with a low melting point. When such voltage-dependent resistor with overheat protection structure is overheated, the heat energy of the voltage-dependent resistor can disconnect the protection device in time, so as to withstand the impulse of a strong lightning current.

Chinese patent No. 200610168133.5 also discloses a voltage-dependent resistor with overheat protection function, wherein an insulated bracket is installed on the body of the voltage-dependent resistor component, and the heating fuse and the pin are electrically connected with each other and are configured on the insulated bracket; when the body experiences an abnormal rise in temperature when receiving a variety of over-high voltages, the heat is conducted to the fuse rapidly thanks to the increased heat-conducting area of the insulation bracket, and at the same time the temperature of the heating fuse rises due to the overheat so that when the temperature is higher than its welding point, causing it to become a fusion liquid state, which, combined with the capillary action resulting from several grooves set in the insulated bracket, further causes the fusion liquid-phase fuse to spread, melt and separate rapidly, thereby protecting the body from igniting and burning, enabling timely circuit breaking to protect the electronic components in the circuit from being damages.

SUMMARY

Described herein is voltage-dependent resistor with overheat short circuit protection structure which will not easily explode and burn, so as to solve the safety problem of the existing voltage-dependent resistor.

More specifically, this patent application describes a voltage-dependent resistor with an overheat short circuit protection structure. The voltage-dependent resistor includes a ceramic body and the two opposite sides of the ceramic body are configured with two metal electrodes, and each of the metal electrodes is connected to one electrode lead, wherein the voltage-dependent resistor further includes a conductive connector, the conductive connector being set on the metal electrodes with a heat-fusing insulating layer in between so that the conductive connector can connect with each of the metal electrodes when the heat-fusing insulating layer is melt.

The voltage-dependent resistor described herein is designed so that when an excessively high voltage, which is higher than its rated voltage, is applied to the voltage-dependent resistor and after the generated or accumulated heat exceeds a certain limit, the heat-fusing insulating layer will be melted down and the conductive connector will be in direct contact with the metal electrodes, causing a short circuit between the two electrode leads, thereby protecting the ceramic body and the voltage-dependent resistor from exploding, burning and ensuring the safety of other electric components.

In the voltage-dependent resistor, the ceramic body can be the ceramic chip of any existing voltage-dependent resistor, such as zinc oxide ceramic chip or ceramic chip of zinc oxide mixed with other metal oxide; of course, the overheat short circuit protection structure of the voltage-dependent resistor also applies to the voltage-dependent resistor chip made of any new material developed in the future.

In the voltage-dependent resistor, the ceramic body can be in any shape as required, for example, the ceramic body can be round, square, rectangular, oval, triangular or other irregularly shaped sheeting, and the ceramic body can also be a block or column, etc.; there are also no special requirements for the shape of the metal electrodes, and it can be determined depending on the specific application. The metal electrodes may be metal layers configured on the ceramic body, such as silver layers or silver alloy layers calcined onto the ceramic body.

When the ceramic body is a sheeting structure, the metal electrode can be configured on the front and rear side of the sheeting ceramic body.

In the voltage-dependent resistor, the conductive connector can be any mechanism allowing the electric connection between the metal electrodes.

The conductive connector can apply a certain clamping force to the heat-fusing insulating layer and the ceramic body.

The heat-fusing insulating layer can be a heat-fusing insulating film; the heat-fusing insulating film can be made of polypropylene insulating material, etc.

In an embodiment, the voltage-dependent resistor has a conductive connector of a metal clamp structure, and the metal clamp structure is clamped on the metal electrodes over the heat-fusing insulating layer. The metal clamp structure maintains a certain pressure or clamping force on the heat-fusing insulating layer and the ceramic body.

In the voltage-dependent resistor, appropriate metal spacers may further be provided between each heat-fusing insulating layer and each metal electrode. Such design increases the area of contact with the metal electrodes, and also plays a role in protecting the metal electrodes.

The metal clamp structure may have several raised parts facing the ceramic body at the place which is in contact with the heat-fusing layer so that when the heat-fusing insulating layer is melt down, the metal clamp structure will have a better electric connection with each of the metal electrodes. For example, several raised points can be configured on the contact surface between the metal clamp structure and the heat-fusing insulating layer. Such design can ensure that the raised points of the metal clamp structure can contact with the metal electrodes or metal spacers effectively when the heat-fusing insulating layer is melt down.

Furthermore, separation grooves can also be set between the raised parts of the metal clamp structure, and the separation grooves divide the front end of the metal clamp structure into several metal strips, and the raised parts can be set at the end of the corresponding metal strips. Such design improves the elasticity of the metal clamp structure to maintain the clamping force on the ceramic body, making it easy to contact with each of the metal electrodes when the heat-fusing insulating layer is melted down.

After the heat-fusing insulating film of the voltage-dependent resistor is melted down when an excessively high voltage is applied to the voltage-dependent resistor, the metal clamp contacts with the metal spacer or the metallized layer, causing a short circuit between the two leads. Through an external test, we find that the voltage between the leads of the voltage-dependent resistor is too low at the rated working voltage (less than the voltage-dependent voltage), which can be easily detected through the external circuit to give a warning signal, making it easy for the operators to discover, repair and change the voltage-dependent resistor in time.

The new voltage-dependent resistor with overheat short circuit protection structure has the advantage of simple structure, being safe to use, being unlikely to explode and burn, and being able to be used as the overvoltage protector for all kinds of the electronic and electrical equipment.

Combining with the drawings, the voltage-dependent resistor is further described below through the embodiments, but these embodiments are not intended to limit the claims.

DETAILED DESCRIPTION

In the figures: 1 is the ceramic body, 2 is the metal electrode, 3 is the electrode lead, 4 is the metal clamp, 5 is the heat-fusing insulating film, 6 is the raised point (raised towards the heat-fusing insulating film), 7 is the separation groove, 8 is the metal strip, 9 is the metal spacer.

Figure 1:
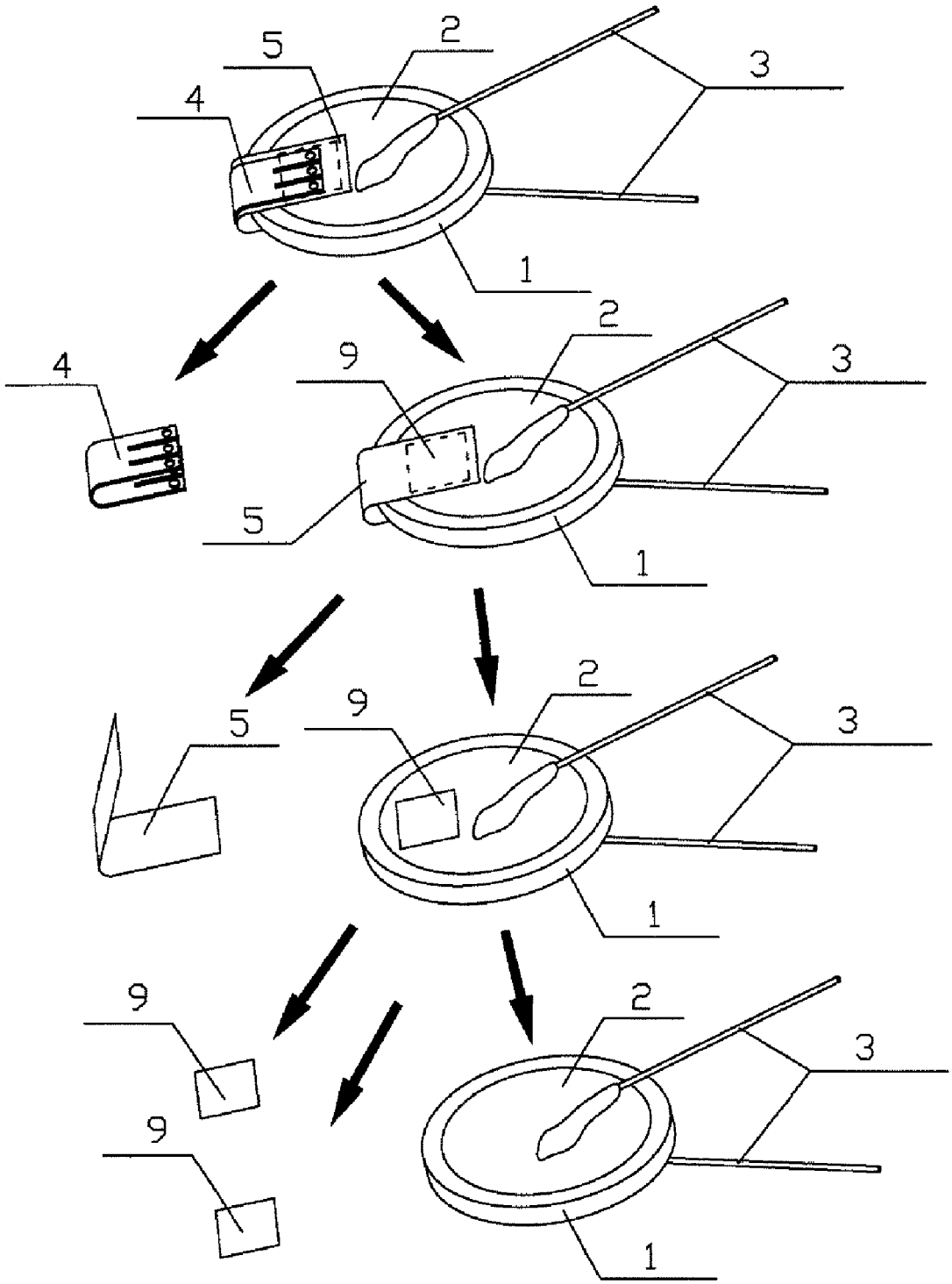
FIG. 1 is the breakdown structure schematic of the voltage-dependent resistor with overheat short circuit structure.

As shown in FIG. 1, a voltage-dependent resistor with overheat short circuit structure includes the ceramic body 1, the metal electrode 2 which is set on the front and back side of the ceramic body 1, and the electrode lead 3 which is welded onto the metal electrode 2, and further includes the metal clamp structure 4 which clamps on the ceramic body over the heat-fusing insulating film 5 and the insulation between the metal clamp structure 4 and the metal electrode is 2 made of the heat-fusing insulating film 5.

Figure 2:
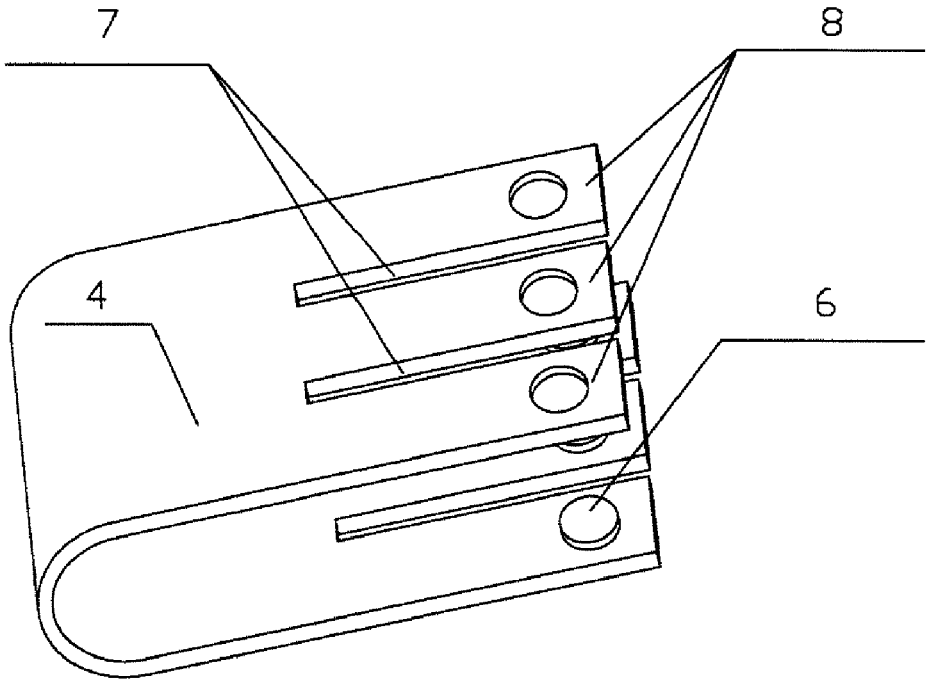
FIG. 2 is the magnified structure schematic of the metal clamp in FIG. 1.

As shown in FIG. 2, three raised points 6 are set on the contact surface between the metal clamp structure 4 and the heat-fusing insulating film 5. Two separation grooves 7 are set between these raised points 6, and the separation grooves 7 divide the front end of the metal plate into three metal strips 8, and the raised points 6 are set at the end of the metal strips 8. The metal spacer 9 is set between the heat-fusing insulating film 5 and the metallized layer 2. The heat-fusing insulating film 5 is made of polypropylene insulation material. The metal electrode 2 is made of silver or copper.

Figure 3:
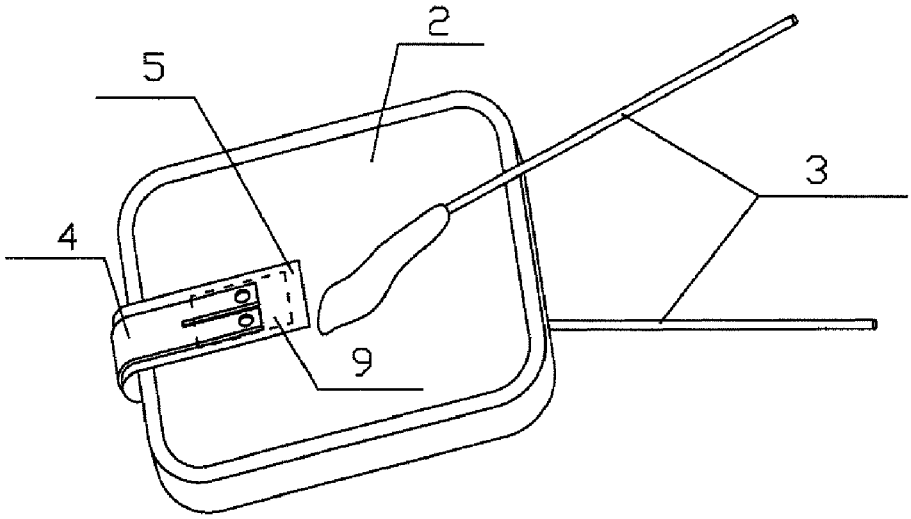
FIG. 3 is the structure schematic of the embodiment 2 of the new voltage-dependent resistor.

As shown in FIG. 3, the structures and components are the same as in Embodiment 2 except that the ceramic body 1 is a square shape and there are only two raised points 6 at the end of the metal clamp structure 4.

The terms mentioned above are used only for illustration, so that the voltage-dependent resistor can be thoroughly understood. However, those of ordinary skill in the field will appreciate that some specific details used to implement the voltage-dependent resistor may not be necessary. Therefore, the above description of the embodiments of the voltage-dependent resistor is provided for example and illustration only. The description should not be considered exhaustive, or the claims limited to the described forms. It is apparent that various changes and modifications can be made under the inspiration of the above teaching. The selected and described embodiments are at best explain the principles and actual applications of the voltage-dependent resistor, and allow those of ordinary skill in this field to best use the voltage-dependent resistor, and variable embodiments apply to various intended uses.

The invention claimed is:

1. A resistor comprising:

a ceramic body;

metal electrodes on sides of the ceramic body, each of the metal electrodes being connected to an electrode lead;

an insulating layer contacting a metal electrode among the metal electrodes, the insulating layer being meltable in response to heat; and a conductive connector contacting the insulating layer above the metal electrode and configured to short at least two of the metal electrodes when the insulating layer melts;

wherein the conductive connector comprises a metal clamp structure that clamps onto the metal electrode over the insulating layer;

wherein the metal clamp structure comprises raised parts facing the ceramic body at points of contact with the insulating layer so that, when the insulating layer melts, the metal clamp structure is in electrical contact with at least part of the metal electrode; and wherein the metal clamp structure comprises separation grooves separating the raised parts, the separation grooves dividing a front end of the metal clamp structure into metal strips.

2. The resistor of claim 1, wherein the raised parts are at ends of the metal strips.

3. The resistor of claim 1, wherein the insulating layer comprises polypropylene insulating film.

4. The resistor of claim 1, wherein the insulating layer contacts the metal electrodes, and wherein the resistor further comprises:

a metal spacer between each metal electrode and corresponding part of the insulating layer.

5. The resistor of claim 1, further comprising:

a metal spacer between the metal electrode and corresponding part of the insulating layer.

6. The resistor of claim 1, wherein the metal electrodes comprise silver or copper.

7. The resistor of claim 1, wherein metal electrodes are circular in shape.

8. The resistor of claim 1, wherein the metal electrodes are square in shape.

9. The resistor of claim 1, wherein the insulating layer contacts each of the metal electrodes; and wherein the conductive connector contacts the insulating layer above each of the metal electrodes.

10. The resistor of claim 1, wherein the insulating layer contacts the metal electrodes, and wherein the resistor further comprises:

a metal plate between each of the metal electrodes and corresponding part of the insulating layer.

11. A resistor comprising:

a ceramic body;

metal electrodes on sides of the ceramic body, each of the metal electrodes being connected to an electrode lead;

fixing means for fixing each of the metal electrodes to a corresponding electrode lead;

an insulating layer contacting a metal electrode among the metal electrodes, the insulating layer being meltable in response to heat;

contacting means for contacting the insulating layer above the metal electrode and for shorting at least two of the metal electrodes when the insulating layer melts; and a metal spacer between the metal electrode and a corresponding part of the insulating layer.

12. The resistor of claim 11, wherein the metal spacer comprises metal paste.

13. The resistor of claim 11, wherein the fixing means comprises a weld.

* * * * *